US008025551B2

(12) United States Patent
Torres et al.

(10) Patent No.: US 8,025,551 B2
(45) Date of Patent: Sep. 27, 2011

(54) MULTI-MODE THREE WHEELED TOY VEHICLE

(75) Inventors: Ronald L. Torres, El Segundo, CA (US); Christopher J. Hardouin, Mar Vista, CA (US); Mark S. Mayer, Woodland Hills, CA (US); Tin Hung Ngai, Kowloon (HK); Chun Wing Wong, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 785 days.

(21) Appl. No.: 11/857,026

(22) Filed: Sep. 18, 2007

(65) Prior Publication Data

US 2008/0220692 A1 Sep. 11, 2008

Related U.S. Application Data

(60) Provisional application No. 60/826,345, filed on Sep. 20, 2006, provisional application No. 60/941,574, filed on Jun. 1, 2007.

(51) Int. Cl.
*A63H 17/00* (2006.01)

(52) U.S. Cl. ..... 446/431; 446/435; 446/436; 446/437; 446/443; 446/456; 446/465

(58) Field of Classification Search ..... 446/431, 446/436, 437, 440, 457, 470, 435, 443, 438, 446/454, 465, 448, 469; 180/212
See application file for complete search history.

(56) References Cited

U.S. PATENT DOCUMENTS

| | | | |
|---|---|---|---|
| 962,308 | A | 6/1910 | Burnett |
| 2,121,355 | A | 6/1938 | Krupp |
| 2,770,074 | A | 11/1956 | Jones et al. |
| 3,016,966 | A | 1/1962 | Hansen |
| 3,306,390 | A | 2/1967 | Jamme |

(Continued)

FOREIGN PATENT DOCUMENTS

DE 3702660 A1 8/1988

(Continued)

OTHER PUBLICATIONS www.societyofrobots.com/robot_omni_wheel_shtml; *Society of Robots webpage dated* Sep. 17, 2007.

(Continued)

*Primary Examiner* — Gene Kim
*Assistant Examiner* — Scott Young
(74) *Attorney, Agent, or Firm* — Panitch Schwarze Belisario & Nadel LLP

(57) ABSTRACT

A toy vehicle has first, second and third wheels for movement over a surface. Each of the first, second and third wheels has a respective first, second and third axis of rotation that lies between the remaining two other axes of rotation such that the three axes of rotation are mutually adjoining. Each of the three axes of rotation crosses over the other two axes of rotation such that an angle is formed between each adjoining crossing pair of the axes of rotation where each angle is other than a multiple of 90 degrees. Each wheel is individually powered so that the toy vehicle can translate in any horizontal direction regardless of its facing direction. Two of the wheels can be realigned so their axes of rotation are collinear for conventional movement.

25 Claims, 10 Drawing Sheets

U.S. PATENT DOCUMENTS

| | | | | | |
|---|---|---|---|---|---|
| 3,465,843 | A | | 9/1969 | Guinot | |
| 3,789,947 | A | | 2/1974 | Blumrich | |
| 3,792,745 | A | | 2/1974 | Files | |
| 3,876,255 | A | | 4/1975 | Ilon | |
| 3,899,037 | A | | 8/1975 | Yuker | |
| 4,003,584 | A | * | 1/1977 | Zelli | 280/81.5 |
| 4,085,542 | A | | 4/1978 | Mitamura | |
| 4,223,753 | A | | 9/1980 | Bradbury | |
| 4,299,301 | A | | 11/1981 | Janin | |
| 4,335,899 | A | | 6/1982 | Hiscock | |
| 4,558,758 | A | | 12/1985 | Littman et al. | |
| 4,715,460 | A | * | 12/1987 | Smith | 180/7.1 |
| 4,810,229 | A | * | 3/1989 | Shoji | 446/443 |
| 4,813,905 | A | * | 3/1989 | Yamaguchi et al. | 446/438 |
| 4,823,900 | A | | 4/1989 | Farnam | |
| 4,846,758 | A | | 7/1989 | Chou | |
| 4,926,952 | A | | 5/1990 | Farnam | |
| D309,254 | S | | 7/1990 | Guile | |
| D318,791 | S | | 8/1991 | Guile | |
| 5,050,575 | A | * | 9/1991 | Killion | 124/8 |
| 5,213,176 | A | * | 5/1993 | Oroku et al. | 180/168 |
| 5,312,165 | A | | 5/1994 | Spletter | |
| 5,374,879 | A | | 12/1994 | Pin et al. | |
| 5,383,715 | A | | 1/1995 | Homma et al. | |
| 5,643,041 | A | * | 7/1997 | Mukaida | 446/455 |
| 5,667,420 | A | | 9/1997 | Menow et al. | |
| 5,701,878 | A | | 12/1997 | Moore et al. | |
| 5,803,790 | A | | 9/1998 | Tilbor et al. | |
| 5,919,075 | A | | 7/1999 | George et al. | |
| 5,927,423 | A | | 7/1999 | Wada et al. | |
| 6,095,890 | A | | 8/2000 | George et al. | |
| D435,437 | S | | 12/2000 | Guile | |
| 6,224,454 | B1 | | 5/2001 | Cheng et al. | |
| 6,315,109 | B1 | | 11/2001 | Dean | |
| 6,394,203 | B1 | | 5/2002 | Harris | |
| 6,394,876 | B1 | * | 5/2002 | Ishimoto | 446/428 |
| 6,547,340 | B2 | | 4/2003 | Harris | |
| 6,564,955 | B2 | | 5/2003 | Franzen et al. | |
| 6,648,722 | B2 | | 11/2003 | Lynders et al. | |
| 6,726,524 | B2 | | 4/2004 | Yamaguchi et al. | |
| 6,752,684 | B1 | * | 6/2004 | Lee | 446/456 |
| 6,757,936 | B2 | | 7/2004 | Yamaguchi et al. | |
| 6,796,618 | B2 | | 9/2004 | Harris | |
| 6,857,707 | B2 | | 2/2005 | Guile | |
| 7,033,241 | B2 | | 4/2006 | Lee et al. | |
| D529,967 | S | | 10/2006 | Bowen et al. | |
| 7,121,917 | B2 | * | 10/2006 | Hardouin et al. | 446/470 |
| 7,293,790 | B2 | | 11/2007 | Byun et al. | |
| 2002/0112899 | A1 | | 8/2002 | Dijksman et al. | |
| 2003/0034687 | A1 | | 2/2003 | Harris | |
| 2003/0067209 | A1 | | 4/2003 | Marrero | |
| 2003/0075366 | A1 | | 4/2003 | Sabatie | |
| 2003/0082990 | A1 | | 5/2003 | Lynders et al. | |
| 2004/0004390 | A1 | | 1/2004 | Guile | |
| 2005/0134106 | A1 | | 6/2005 | Guile | |
| 2005/0183896 | A1 | | 8/2005 | Fenelli et al. | |

FOREIGN PATENT DOCUMENTS

| | | | |
|---|---|---|---|
| EP | 254 974 | A1 | 2/1988 |
| JP | 62085723 | A1 | 4/1987 |
| JP | 62128832 | A | 6/1987 |
| JP | 63031804 | A | 2/1988 |
| JP | 63043876 | A | 8/1988 |
| JP | 06227205 | A1 | 8/1994 |
| JP | 2003063202 | A | 3/2003 |

OTHER PUBLICATIONS

Kavathekar et al. *The Geometry of time-optimal trajectories for an omni-directional robot*.

Office Action issued Jun. 29, 2010 in China Application Serial No. 200710194429.9.

Palm Pilot Robot Kit at http://www.cs.cmu.edu/~reshko/PILOT/overview.html May 23, 2006 (2 pages).

Acroname, Inc., web page with specification of BrainStem® (4 pages) 1994-2006®.

Fisher-Price Toy Catalog, 2002. p. 76.

* cited by examiner

MULTI-MODE THREE WHEELED TOY VEHICLE

CROSS-REFERENCE TO RELATED APPLICATIONS

This application claims the benefit of U.S. Provisional Patent Application No. 60/826,345 filed Sep. 20, 2006 entitled "Holonomic Motion Toy Vehicle" and U.S. Provisional Patent Application No. 60/941,574 filed Jun. 1, 2007 entitled "Multi-mode Toy Vehicle" which are incorporated by reference herein in their entirety.

BACKGROUND OF THE INVENTION

This invention generally relates to a three wheeled toy vehicle and, more particularly, to a three wheeled vehicle capable of transforming between multiple modes or configurations.

Toy wheeled vehicles are well-known. Three wheeled toy vehicles typically have two parallel axes with two wheels provided on one axis and one wheel provided on the other axis in a T-shaped configuration. Such vehicles translate forward and reverse and turn toward either lateral direction. However, known three wheeled toy vehicles often do not provide lateral translation, pure rotation or a combination of translation and rotation.

Holonomic vehicles have been developed that provide omni-directional motion. Holonomic or omni-directional motion is a robotics term regarding the degrees of freedom. In robotics, holonomicity refers to the relationship between the controllable and total degrees of freedom of a given robot (or part thereof). If the controllable degrees of freedom is greater than or equal to the total degrees of freedom then the robot is said to be holonomic. If the controllable degrees of freedom is less than the total degrees of freedom it is non-holonomic. Holonomic vehicles may move in any translational direction while simultaneously but independently controlling its rotational, orientation and speed about a center of its body. Holonomic vehicles have been developed that either have three or four wheels spaced equiangularly apart such that axes of rotation are mutually adjoining.

What is desired but not provided in the prior art, is a multi-mode three wheel toy vehicle that transforms between a holonomic configuration and a non-holonomic configuration. It is believed that a new toy vehicle providing features and performance of heretofore unavailable motion would provide more engaging play activity than already known vehicles.

BRIEF SUMMARY OF THE INVENTION

Briefly stated, the present invention is directed to a multi-mode three wheeled toy vehicle. The toy vehicle comprises a chassis having first, second and third wheels that are supported for rotation from the chassis and support the chassis for movement on a surface. The first wheel is operably and pivotably connected to the chassis by a first leg. The first leg is pivotable toward and away from the second and third wheels. Each of the first, second and third wheels has a respective first, second and third axis of rotation. Each of the first, second and third axes of rotation lies between the remaining two other axes of rotation such that the three axes of rotation are mutually adjoining. Each of the three axes of rotation crosses over the other two axes of rotation such that an angle is formed between each adjoining crossing pair of the axes of rotation. Each adjoining pair of the first, second and third wheels, and the angle formed between each adjoining pair of the axes of rotation is other than a multiple of about 90 degrees.

In another aspect, the invention is directed to a multi-mode three wheeled toy vehicle which comprises a chassis and three independently operated motors. A rear leg and two front legs each extend from the chassis. The two front legs are pivotably attached to the chassis. Each leg includes a wheel assembly with an axis of rotation generally parallel to the leg from which the wheel assembly is attached. Each wheel assembly is driven by a separate one of the three motors.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

Figure 1:
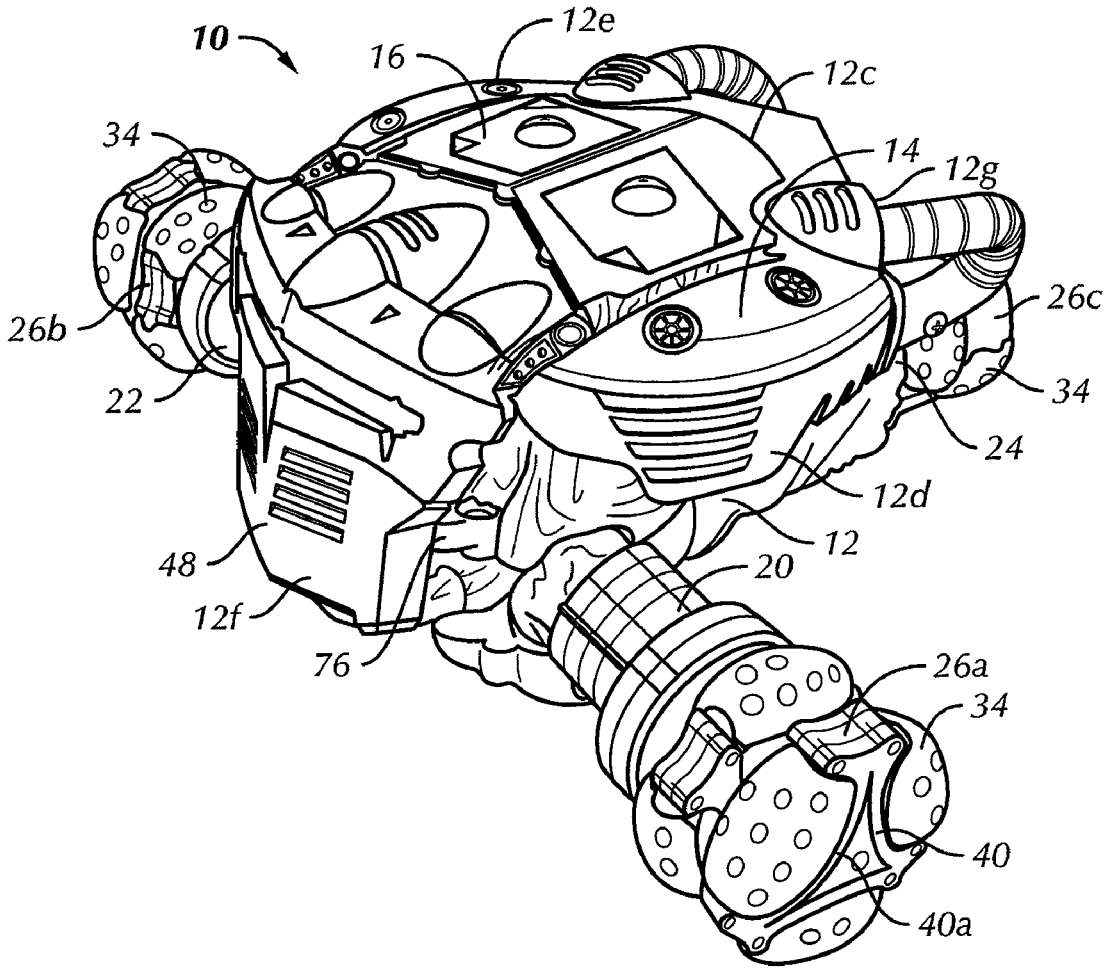
FIG. 1 is a perspective view of the upper, front and left sides of a toy vehicle in accordance with a preferred embodiment of the present invention shown in a first configuration and mode.
Figure 2:
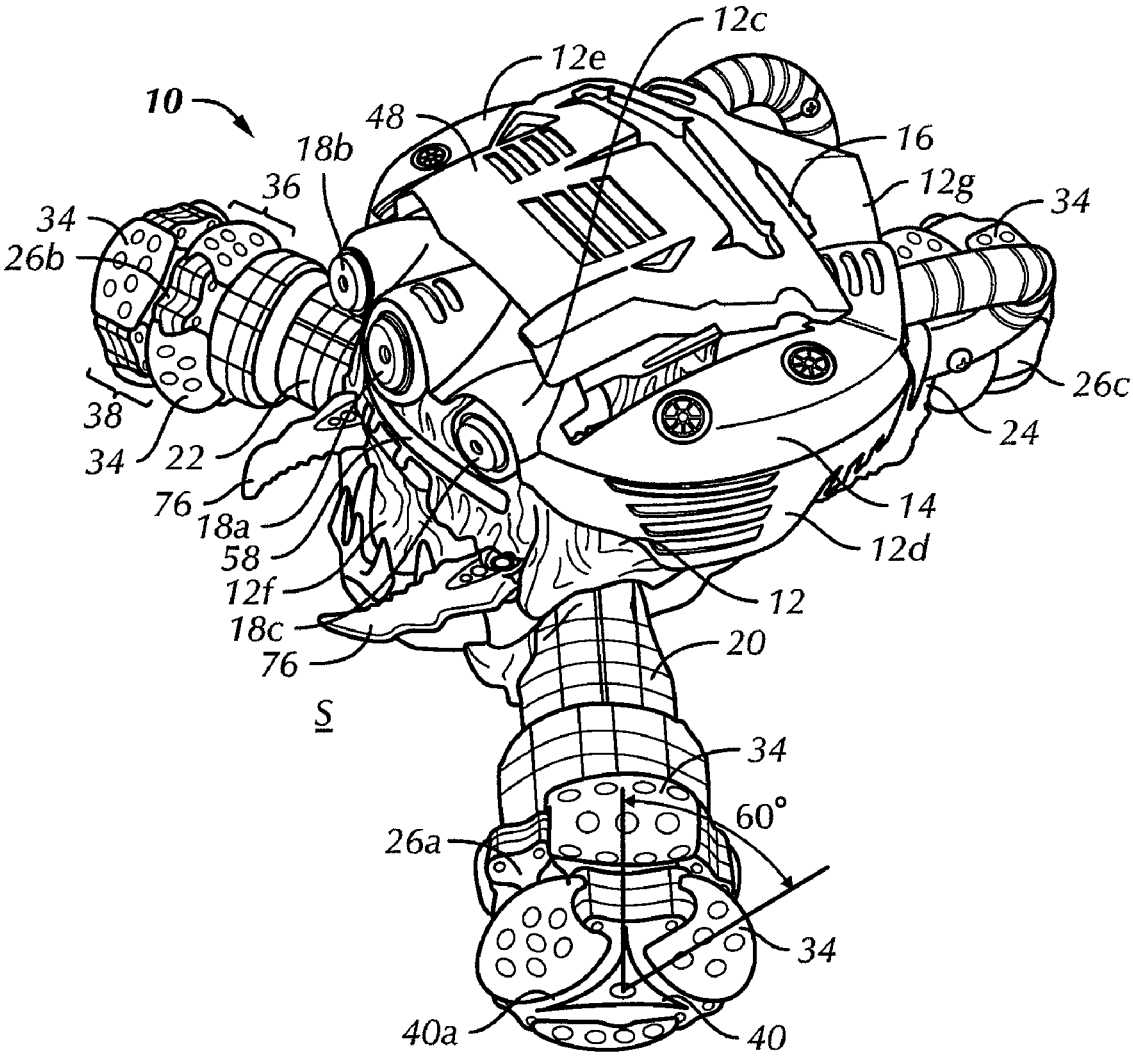
FIG. 2 is a perspective view of the upper, front and left sides of a toy vehicle of FIG. 1 shown in a second configuration and mode.
Figure 8:
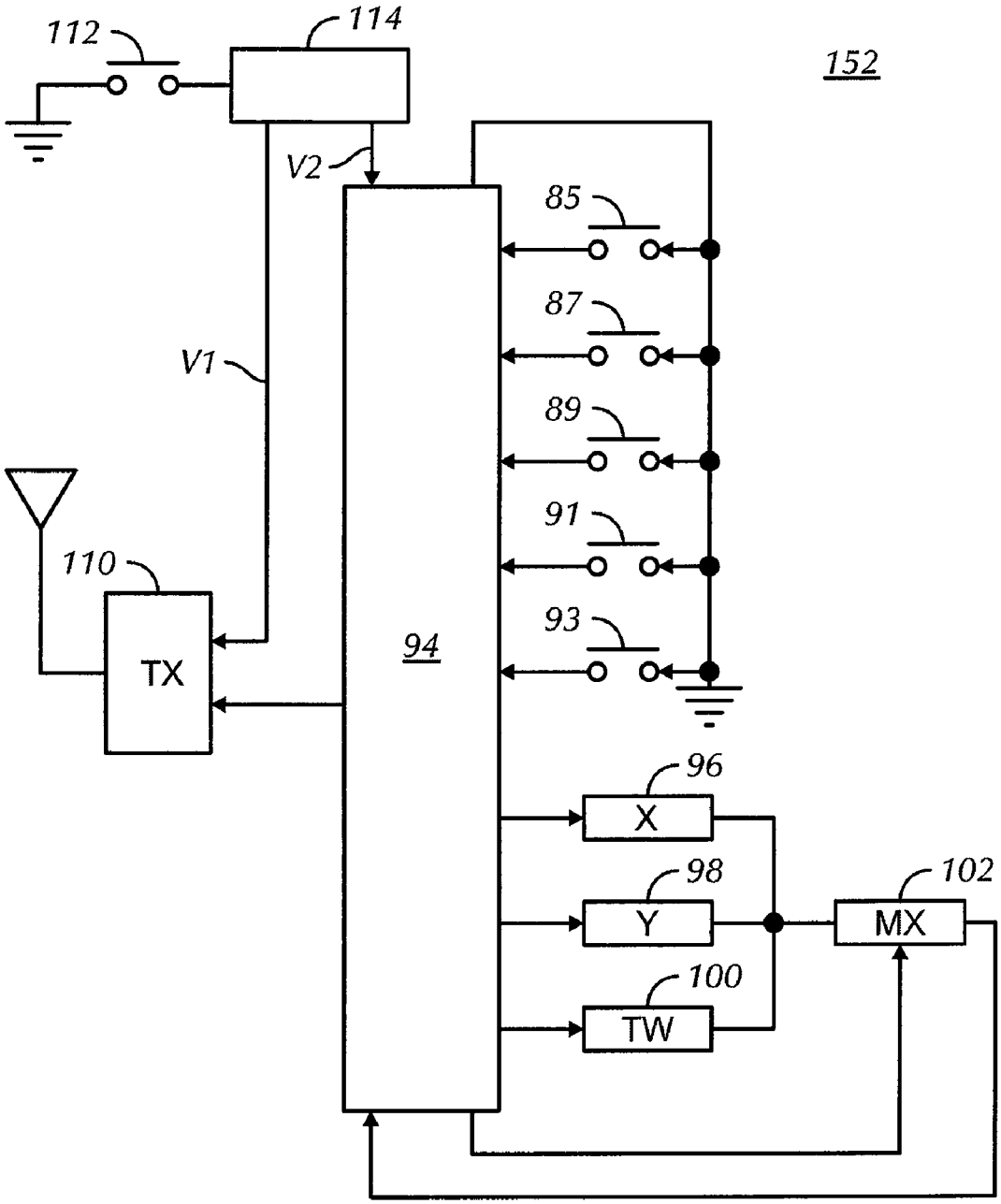
FIG. 8 is a schematic of the control circuitry of the remote control of FIG. 15.
Figure 9:
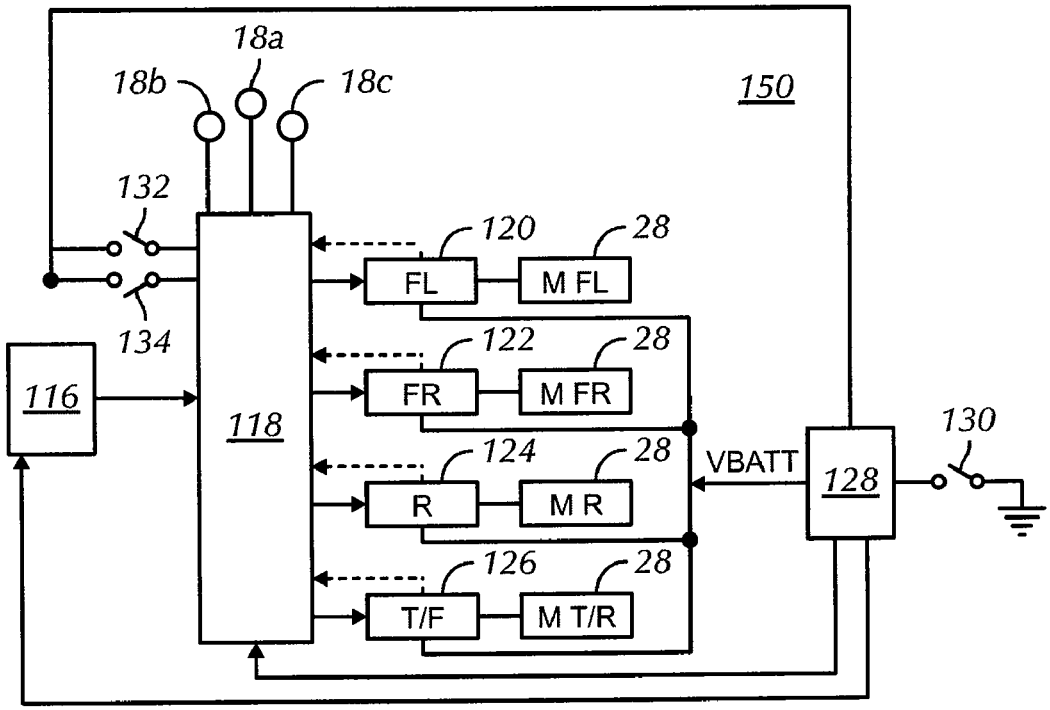
Figure 10A:
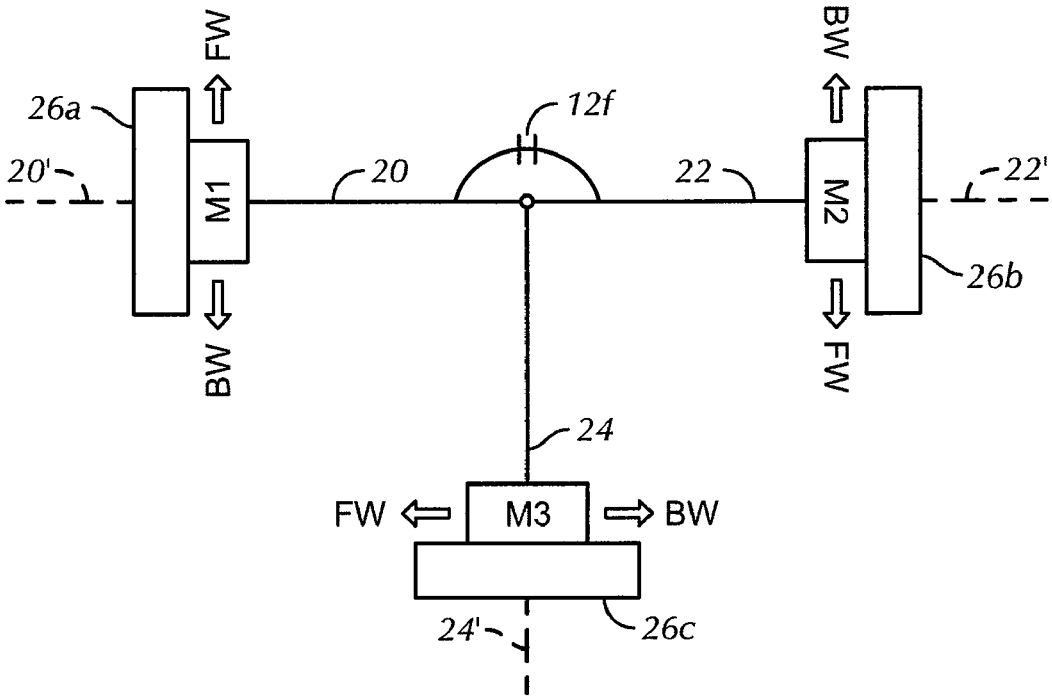
Figure 10B:
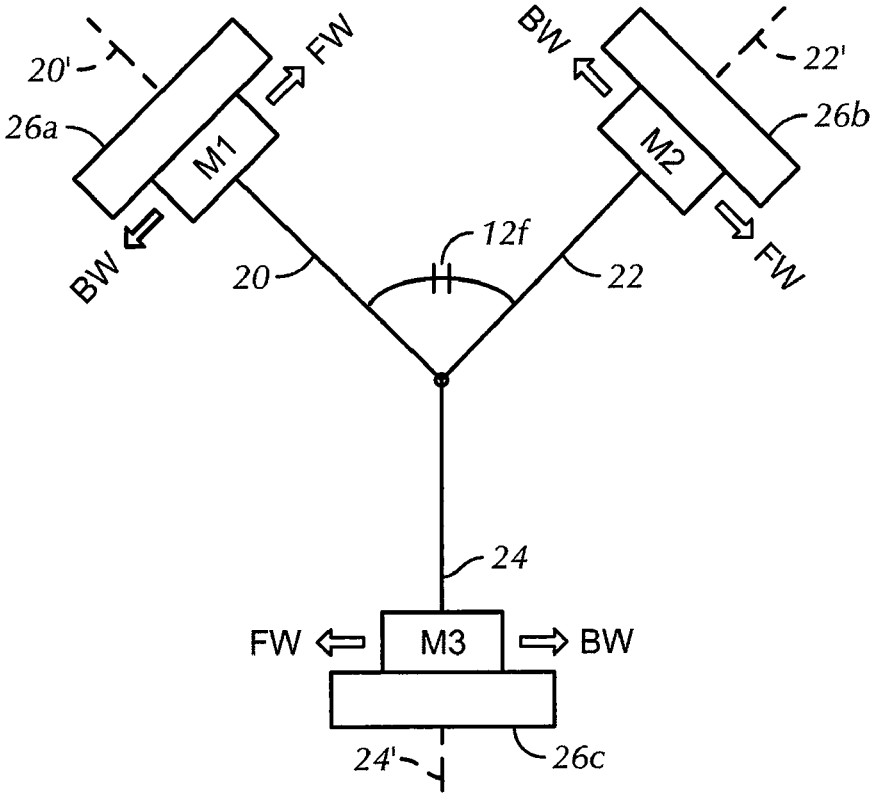

FIG. **8*a* is a schematic of a position sensor of the remote control transmitter circuit of FIG. 8**;

FIG. 9 is a schematic of the vehicle control circuit of the toy vehicle of FIG. 1;

FIG. 10A is a schematic of the driver motor control direction of the toy in the first configuration and mode of FIG. 1; and FIG. 10B is a schematic of the drive motor control direction of the toy vehicle in the second configuration and mode of FIG. 2.

DETAILED DESCRIPTION OF THE INVENTION

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of a multi-mode three wheeled toy vehicle in accordance with the present invention, and designated parts thereof. Unless specifically set forth herein, the terms "a", "an" and "the" are not limited to one element but instead should be read as meaning "at least one". The terminology includes the words noted above, derivatives thereof and words of similar import.

Referring to the figures in detail, wherein like numerals indicate like elements throughout, there is shown in FIGS. 1-10B a presently preferred embodiment of a multi-mode three wheeled toy vehicle (or simply "toy vehicle") 10. With reference initially to FIGS. 1-2, the toy vehicle 10 comprises a body assembly or chassis 12. The chassis has a first major or top side 12*c* and a second major or bottom side (not shown) opposite the first major side 12*c*, a first lateral or left side 12*d* and a second lateral or right side 12*e* opposite the first lateral side 12*d* and first or front end 12*f* and a second or rear end 12*g* opposite the first end 12*f*. The chassis 12 supports a decorative outer housing 14. The decorative outer housing 14 may be comprised of any shape to give the toy vehicle 10 any appearance such as a robot, vehicle, or insect for example. The outer housing 14 may include a translucent or transparent window 16 on the top side 12*c*. The outer housing 14 and/or window 16 may be removable to allow access to the parts such as a disk launcher 58 and electric components on the chassis 12. The window 16 may also be disposed over a light source such as an LED (not shown) to illuminate the window 16 and create a visually appealing display.

Referring to FIG. 2, the currently preferred chassis 12 includes at least one and preferably a plurality of lights 18*a*, 18*b*, 18*c* (collectively 18) on the front end 12*f* of the chassis 12. The lights 18 are preferably LEDs or low powered lasers each capable of projecting a beam of light on a target or to form a light pattern on an object. The lights 18 may be constantly on when the toy vehicle is on, on only when the vehicle is in motion or moving in a certain motion, on automatically when the surrounding area is sufficiently dimly lit, manually on when selected by the user, or on when the toy vehicle 10 is in an attack mode as discussed further below.

Figure 6:
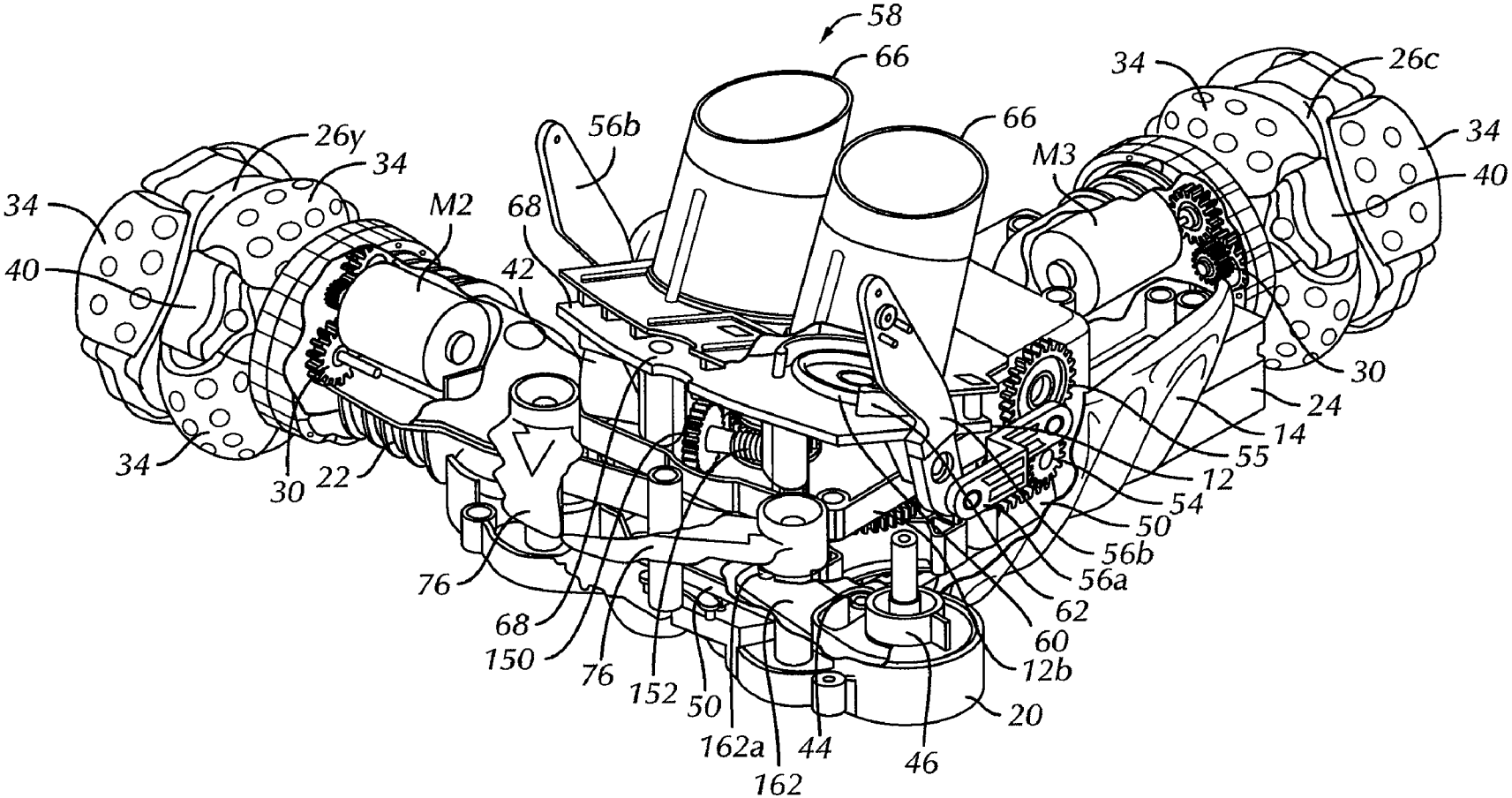
FIG. 6 is a perspective view of the front, bottom and left sides of a portion of the chassis of the toy vehicle of FIG. 1.
Figure 7:
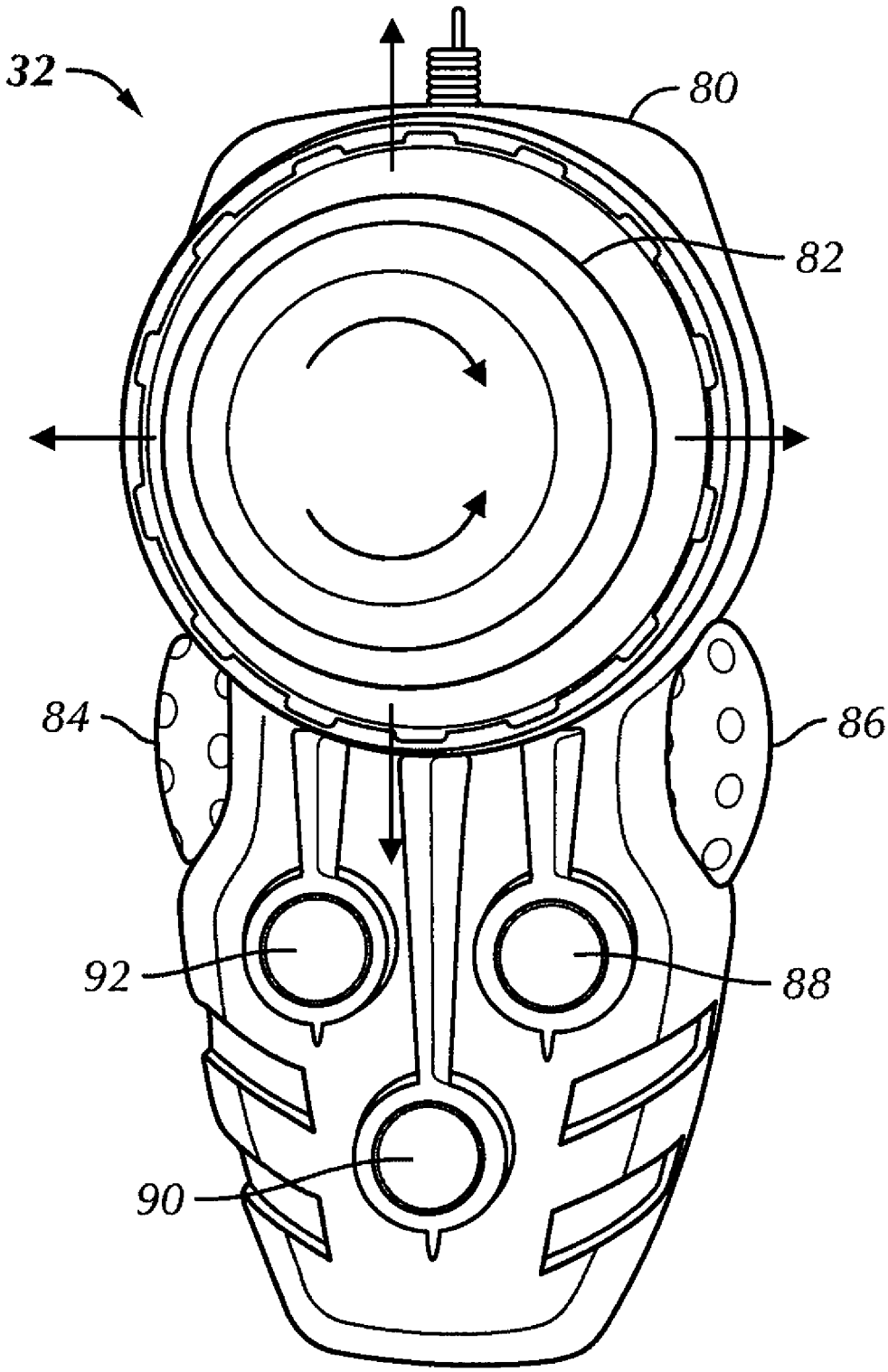
FIG. 7 is a front perspective view of the remote control of the toy vehicle of FIG. 1.

Referring to FIGS. 1-2 and 6, pivotably attached to the chassis 12 is a first or left leg 20 and a second or right leg 22 toward the front end 12*f*. A third or rear leg 24 extends from the rear end 12*g* of the chassis 12. Though it is preferred that the rear leg 24 is not pivotable, it is within the spirit and scope of the invention that the rear leg 24 is pivotable as well. Preferably, an identical wheel assembly 26 is rotatably mounted to the distal, free end of the left, right, and rear legs 20, 22, 24. The wheel assembly 26 preferably includes an omni-directional wheel as discussed further below. A reversible electric drive motor M1, M2, M3 (FIG. 6) is positioned within each leg 20, 22, 24, respectively. The drive motors M1, M2, M3 drive each wheel assembly 26*a*, 26*b*, 26*c* individually about an axis 20', 22', 24' (See FIGS. 10A, 10B) parallel to and extending longitudinally through the left, right, and rear legs 20, 22, 24. Each drive motor M1, M2, M3 is connected to a preferably identical reduction transmission 30 (FIG. 6) which in turn drives the associated wheel assembly 26. The wheel assemblies 26*a*, 26*b*, 26*c* may be driven in either direction utilizing a remote control 32 (FIG. 7) to translate or rotate the toy vehicle 10 or both as discussed further below.

Preferably, the toy vehicle 10 is configured to transform or "toggle" between a first, preferably orthogonal or T-shaped "interceptor" mode (FIGS. 1 and 10A) and a second, preferably equiangular or Y-shaped "attack" mode (FIGS. 2 and 10B). The toy vehicle 10 is further preferably configured to operate in two different motive modes, a conventional motion mode with at least two parallel wheel assemblies 26 (e.g. T-shaped or orthogonal "interceptor" mode") and an omni-directional or holomonic motion mode preferably with no parallel wheel assemblies 26 (e.g. the Y-shaped non-orthogonal "attack" mode) for steering or propulsion. FIGS. 1 and 10A depict the first, orthogonal or T-shaped mode of the vehicle 10 for conventional motion with the left and right legs 20, 22 being separated from one another by about 180 degrees across the forward end of the toy vehicle 10 and from the rear leg 24 by about 90 degrees. Wheels 26*a*, 26*b* are parallel. Preferably, the legs 20, 22, and 24 of the toy vehicle 10 can be transformed from the T-shaped mode shown in FIGS. 1 and 10A to the Y-shaped mode shown in FIGS. 2 and 10B. In the preferred orthogonal mode, the left and right legs 20, 22 are co-linear with their wheel assemblies 26 and respective axes of rotation 20', 22', all lying along a common axis, and the rear leg 24 is perpendicular to the left and right side legs 20, 22. In the Y-shaped mode, the left and right legs 20, 22 are pivoted forward towards one another and away from the third leg 24 forming a "Y" configuration out of the legs 20, 22, 24. Preferably, left and right legs 20, 22 are each pivoted about 30° from their orthogonal, positions whereby the three legs 20, 22, 24 are at least generally equiangularly spaced apart about 120°. In the T-shaped mode, the toy vehicle 10 can be propelled in a conventional fashion by drive of just the wheel assemblies 26*a*, 26*b* of the left and right side legs 20, 22. When turning, wheel assembly 26*c* of the rear leg 24 can optionally be driven in the direction of the turn to provide additional power for steering and propulsion. In the non-orthogonal Y-shaped mode, all three wheels 26*a*, 26*b*, 26*c* are preferably driven to provide translational motion in any direction with or without rotation of the vehicle 10.

To foster both modes of operation, each wheel assembly 26 preferably has a plurality of rollers 34. Each roller 34 has an axis of rotation which is normal to the axis of the wheel assembly 26 when projected onto the latter axis. Each wheel assembly 26 includes a first set of rollers 36 (FIG. 2) preferably having three individual rollers 34 equally spaced around the axis of the wheel assembly 26 and a second set of rollers 38 preferably having three individual rollers 34 equally spaced around the axis of the wheel assembly 26. The second set of rollers 38 is located outwardly, distal to the supporting leg 20, 22, 24 and the first set of rollers 36 is located inwardly, proximal to the supporting leg. The first set of rollers 36 is preferably angularly displaced from the second set of rollers 38 by about sixty degrees (see FIG. 2) such that at least one roller 34 of a wheel assembly 26 is always in contact with a surface "S" supporting the wheel assembly 26. The rollers 34 are attached within a support structure or hub 40 and are freely rotatable about their respective axes. The support structure 40 is attached to or forms the axis 20', 22', 24' of the wheel assembly 26 and has six concave recesses 40*a* for receiving and supporting the rollers 34. The rollers 34 are preferably longer axially than radially. In addition, the rollers 34 have tapered ends such that the first and second set of rollers 36 and 38 collectively define a generally circular outer circumference of the wheel assembly 26. More or less than six rollers 34 can be provided on each wheel assembly 26. Though it is preferred that the wheel assemblies 26*a*, 26*b*, 26*c* include two sets of rollers 36 as described above, it is within the spirit and scope of the present invention that more or less sets and more or less rollers 36 are utilized and positioned in any configuration as long as the wheel assembly 26 is capable of rotating and translating as described further below.

Referring to FIGS. 1, 2 while the toy vehicle 10 may be configured to be transformed manually, preferably a separate remotely controlled and preferably reversible central motor 42 is provided for moving the left and right legs 20, 22 towards and away one another between the T-shaped and Y-shaped modes. Preferably, the central motor 42 is also used for firing discs 60 but it is within the spirit and scope of the present invention that an additional motor be used for that or that the central motor 42 or another motor be used for other purposes. Additionally, a front face shield 48 is preferably provided and moves in conjunction with the left and right legs 20, 22. The face shield 48 is actuated between a closed position (FIG. 1) corresponding to the T-shaped or orthogonal mode and a raised position (FIG. 2) corresponding to the Y-shaped or equiangular mode.

Figure 3:
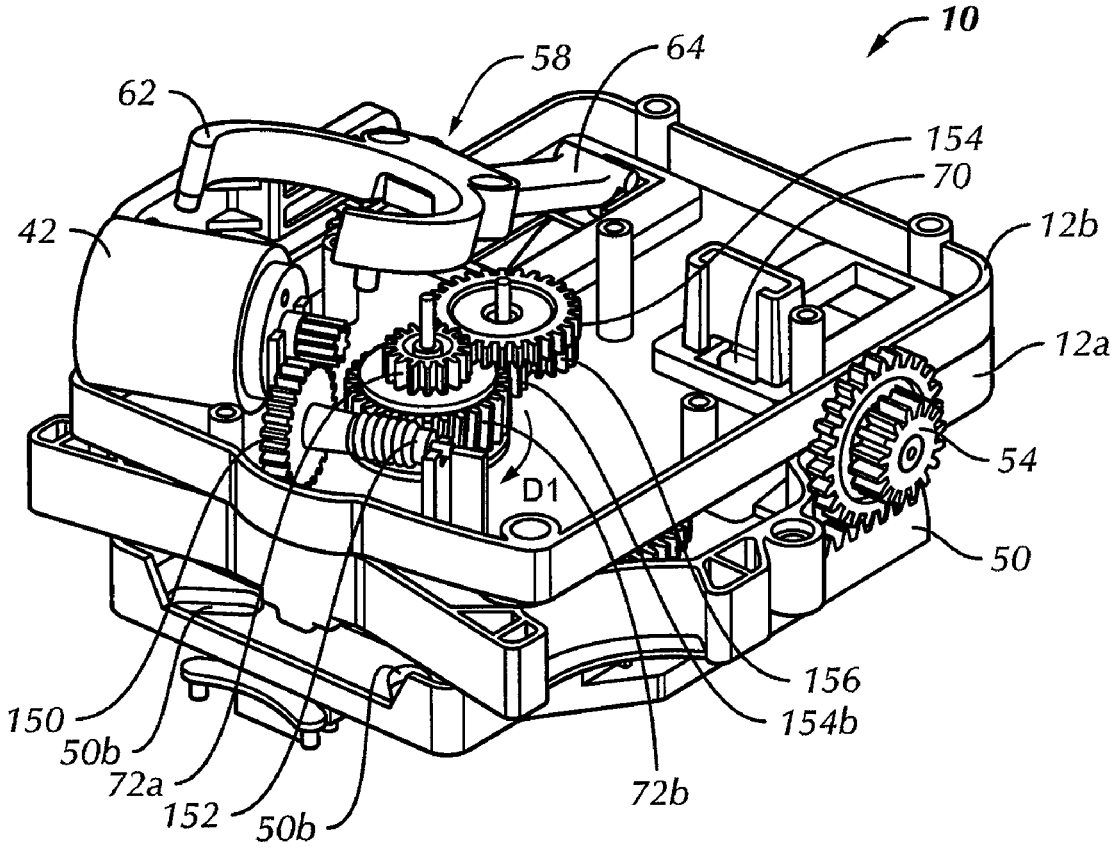
FIG. 3 is a top perspective view of a portion of the chassis of the toy vehicle of FIG. 1.
Figure 4:
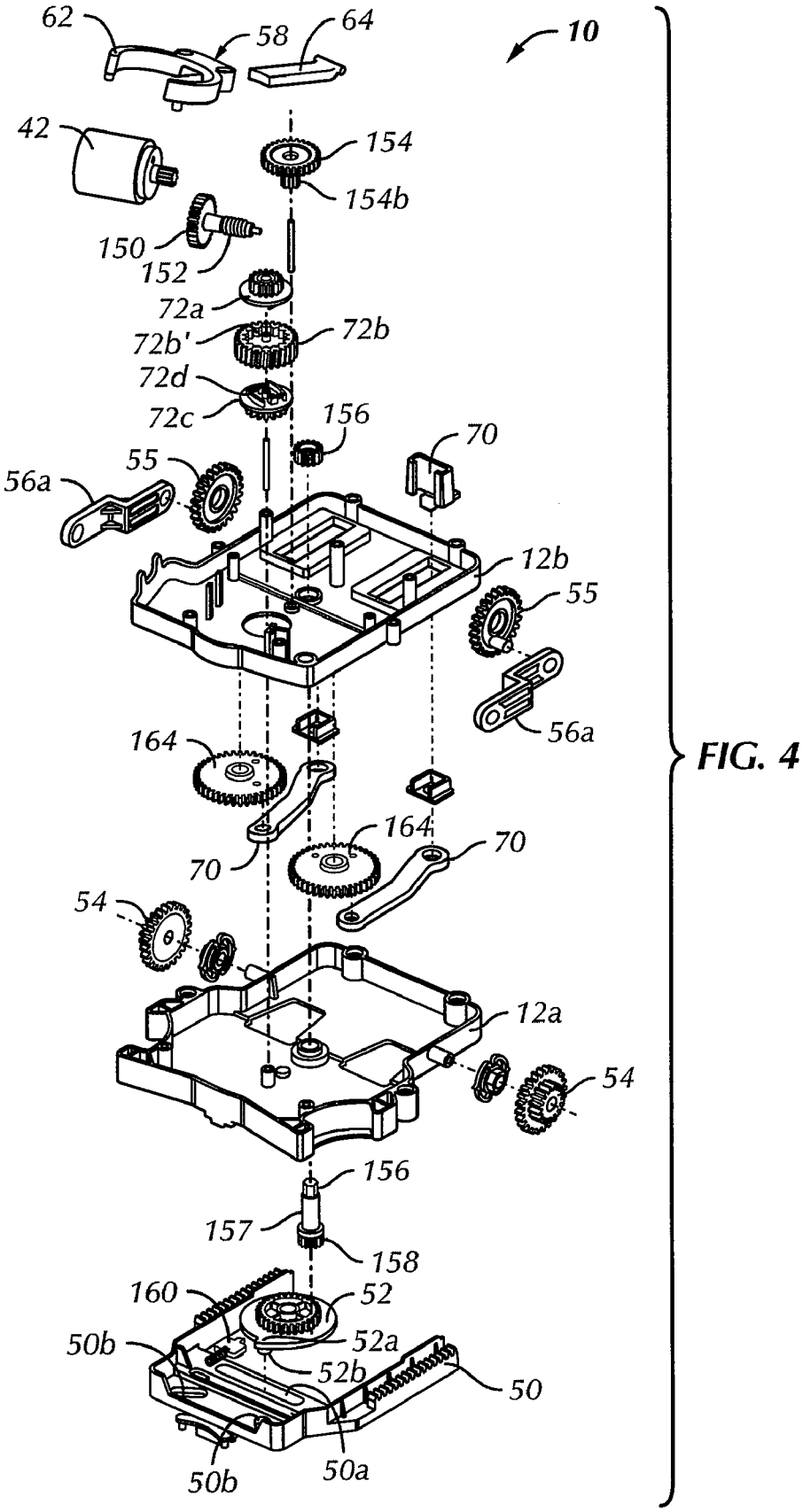
FIG. 4 is an exploded perspective view of a portion of the chassis of the toy vehicle of FIG. 1.
Figure 5:
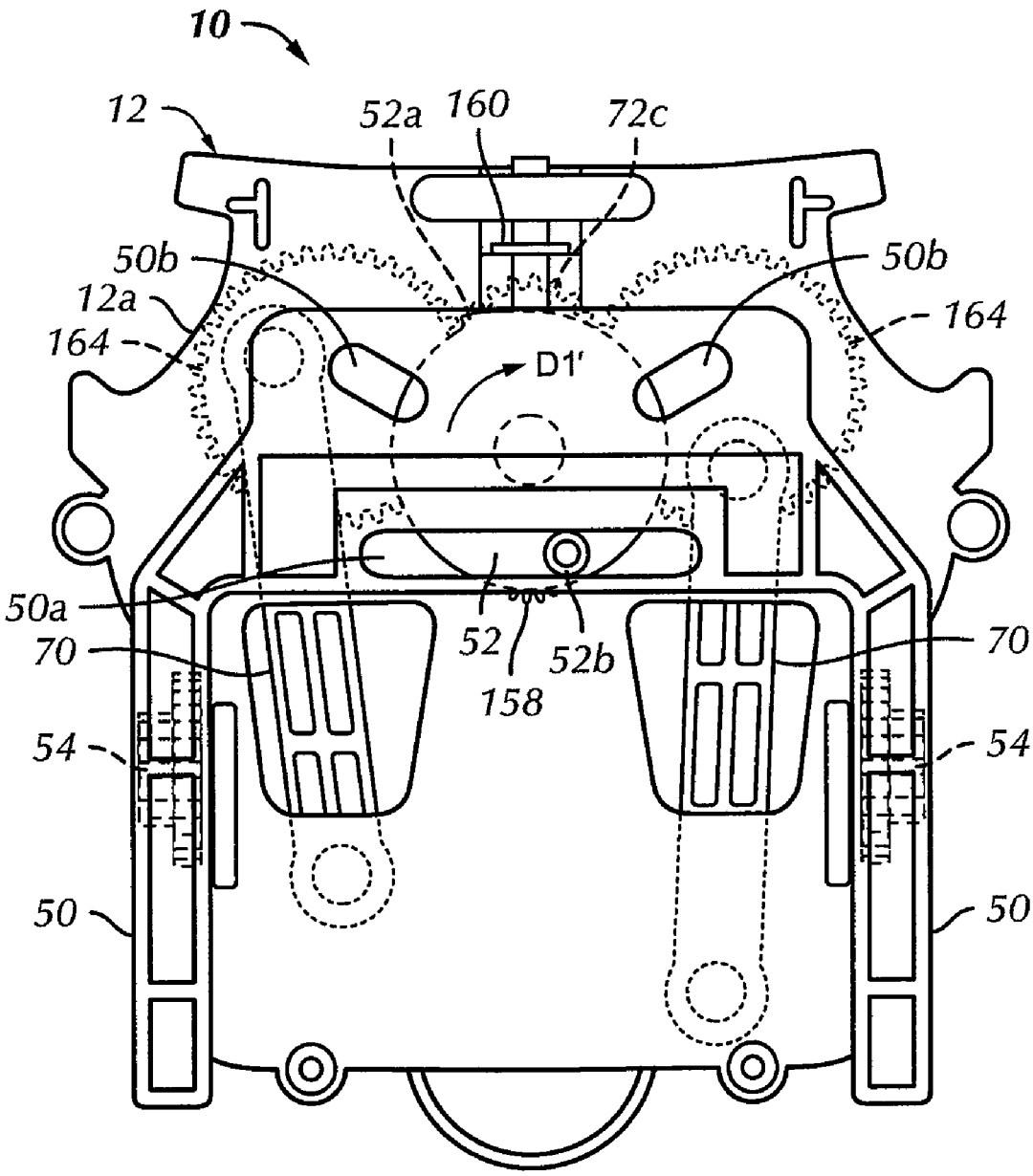
FIG. 5 is a bottom plan view of a portion of the chassis of the toy vehicle of FIG. 1.

Referring to FIGS. 3-5, the central motor 42 drives a first spur gear 150 located on an upper chassis 12*b*. The spur gear 150 is connected to a worm 152 which drives a clutch gear 72 comprised of a top, central and bottom spur gear 72*a*, 72*b*, 72*c* respectively. Within the central spur gear 72*b*, a one way clutch preferably in the form of a pair of spring biased levers 72*d* (FIG. 4) is provided on either side of central spur gears 72*b* between the central spur gear 72*b* and each of the top and bottom spur gears 72*a*, 72*c* respectively. The levers 72*d* are spring biased against a toothed inner surface 72*b*' (FIG. 8) to allow the top and bottom spur gears 72*a*, 72*c* to rotate independently from the central spur gear 72*b* in one direction but are engaged with the toothed surface 72*b*' when rotated in an opposite, second direction to provide one way clutching in opposite directions between the central spur gear 72*b* and the top and bottom spur gears 72*a*, 72*c*. That is, if the top spur gear 72*a* rotates with the central spur gear 72*b* in a first direction D1, then the bottom spur gear 72*c* will rotate with the central spur gear 72*b* only in the second, opposite direction. When the central gear 72*b* is rotated in the first direction D1, the top spur gear 72*a* drives a combination spur gear 154 comprised of a larger diameter spur gear 154*a* driven by the top spur gear 72*a* and a connected smaller diameter spur gear 154*b*. Resistance downstream from the lower gear 72*c* will cause that gear to slip with respect to the central gear 72*b* as it rotates in the D1 direction. The smaller diameter spur gear 154*b* drives a first keyed spur gear 156. The first keyed spur gear 156 rotates a shaft 157 to rotate a second keyed spur gear 158 located underneath the upper chassis 12*b*. The second keyed spur gear 158 drives a pegged gear 52 on the underside of a lower chassis 12*a*. The pegged gear 52 includes a step 52*a*. A peg 52*b* extends axially outwardly from an eccentric position toward the outer diameter of the pegged gear 52. The peg 52*b* is disposed at least partially within a laterally extending slot 50*a* in a rack 50 positioned under the lower chassis 12*a* such that rotation of the pegged gear 52 in a first direction D1' (FIG. 5), cyclically urges the rack 50 towards the front 12*f* and the rear 12*g* of the toy vehicle 10 and chassis 12. The pegged gear 52 rotates freely in the first direction D1' corresponding to the first direction D1 of the top spur gear 72*a*. When the central spur gear 72*b* rotates in the second direction opposite the first direction D1, the pegged gear 52 is driven in the second direction, opposite direction D1', until a spring biased latch 160 engages with the step 52*a* thereby ceasing rotation of the pegged gear 52. If the worm 152 continues to rotate the central spur gear 72*b* in the second direction, the resistive force of the levers 72*d* is overcome, disengaging the levers 72*d* with the toothed surface 72*b*' and allowing the central spur gear 72*b* to continue to rotate and slip with respect to the stationary top spur gear 72*a*.

The rack 50 drives a compound pinion gear 54 pivotably connected to the lateral sides of the chassis 12. The compound pinion gear 54 drives a link spur gear 55 each of which is connected to one of a pair of linkages (FIG. 6) disposed on each lateral side of the toy vehicle 10. The linkages include a drive rod 56*a* actuating a pivotably mounted lever 56*b*. Opposing ends of the drive rod 56*a* are pivotably connected with an eccentric pin on the link spur gear 55 and a proximal end of the lever 56*b*. The free ends of the linkage levers 56*b* are connected to the face shield 48 (FIGS. 1 and 2) to raise and lower the face shield 48.

Referring to FIGS. 4-6, the rack 50 also includes two diagonally extending slots 50*b* positioned toward the front end 12*f*. A pivot arm 162 extends from each of the left and right legs 20, 22. The pivot arms 162 include a pivot arm pin 162*a* extending from the distal end. The pivot arm pins 162*a* are disposed at least partially within the slots 50*b* of the rack 50. Movement of the rack urges the pivot arm pins 162*a* to pivot the pivot arms 162 and thereby pivot the left and right legs 20, 22. The pivot arms 162 may be provided with a jaw peg (not shown) that rotates a jaw shaft 76*a*. A pair of jaws 76 is extend from the front end 12*f* of the chassis 12. The jaws 76 move towards the center of the front end 12*f* of the chassis 12 and rotate out towards the left or right lateral sides 12*d*, 12*e* of the toy vehicle 10 as the left and right legs 20, 22 are rotated. The jaws are preferably frictionally positioned on the jaw shafts 76*a* such that a user can manually position the jaws 76 in addition to the movement provided by the pivot arms 162. Though the above described operation is preferred, the jaws 76 may extend outwards and then inwards determined by a certain position of the toy vehicle 10, selection by the user, or when the disc launcher 58 is in use. Alternatively, the jaws 76 may be motor driven and controlled automatically by an on-board radio receiver/controller or independently remotely controlled.

A limit peg 44 preferably is disposed within the pivot arms 162 and prevents over rotation of the left and right legs 20, 22. As the top spur gear 72*a* is driven in the first direction D1, the left and right legs 20, 22 are pivoted or positioned between the T-shaped and Y-shaped modes. If the central motor 42 is reversed and the top spur gear 72*a* is driven in the second direction (opposite D1 and D1'), the pegged gear 52 rotates in the second direction until the left and right legs 20, 22 are positioned in the Y-shaped or "attack" mode at which point step 52*a* is engaged by the spring biased latch 160 (FIG. 5). The toy vehicle 10 remains in the Y-shaped position even if the central motor 42 continues to rotate in the second direction. The left and right side legs 20, 22 are then only moveable once the direction of the central motor 42 is reversed.

Referring to FIG. 6, the chassis 12 further preferably supports a toy disk launcher, indicated generally at 58, that is generally aligned with one or more of the light beams emitted from the one or more lights 18. The disc launcher 58 ejects generally flat and cylindrically shaped polymeric discs 60 from the front end 12*f* of the chassis 12. The disc launcher 58 includes two generally c-shaped snap rings 62. The snap rings 62 have a diameter larger than the discs 60. Canisters 66 hold stacks of disks 60 over the snap rings 62 to gravity feed a subsequent disc 60 into the snap ring 62 after each firing. An urging member 64 (FIG. 10) is slidably disposed through the rear of each of the snap rings 62. The urging member 64 pushes through the front opening 62*a* of the snap ring 62, each of the discs 60 dropped into the snap ring 62. The disc 60 spreads apart the opening 62*a* of the snap ring 62 as it is urged through the opening 62*a* of the snap ring 62 and once the diameter (the largest width) of the disc 60 passes through the opening 62*a* of the snap ring 62, the resiliency of the snap ring 62 causes the disc 60 to be launched forward. The canisters 66 are positioned on a platform 68. The platform 68 provides a surface for the fired disc 60 and is attached to the chassis 12.

Referring to FIG. 4, slide arms 70 are preferably pivotally connected to the urging members 64. The slide arms 70 slide back and forth to alternatively push discs 60 through the openings 62*a* to fire the discs 60. Preferably, the slide arms 70 are each driven by a slide spur gear 164 located between the upper and lower chassis 12*b*, 12*a*. Both slide spur gears 164 are driven by the bottom spur gear 72*c* which extends through the upper chassis 12*b*. The bottom spur gear 72*c* is only driven when the central spur gear 72*b* is driven in the second direction thereby firing discs 60 only when the face shield 48 is open and the left and right legs 20, 22 are in the Y-shaped or attack mode.

Though it is preferred that one motor is used to operate the left and right legs 20, 22, the face shield 48 and the disc launcher 58, it is within the spirit and scope of the present invention that more than one motor be used or alternative drive mechanisms be utilized or both.

In the Y-shape or "attack" mode, the toy vehicle 10 can move omni-directionally or holonomically across support surfaces, meaning that it may move in any translational direction while simultaneously but independently controlling its rotational orientation and speed about a center of its chassis 12. When the wheel assemblies 26 are rotated in the same direction clockwise or counterclockwise and at the same rate, the toy vehicle 10 will spin or rotate about the center of the chassis 12 with no radial (i.e. translational) motion. For example, when all of the wheel assemblies 26 rotate clockwise, the toy vehicle rotates in a clockwise direction. When only one of the three wheel assemblies 26 rotates while the remaining wheel assemblies 26 do not rotate, the toy vehicle 10 will translate and rotate in the direction of the rotating wheel assembly 26. The nonrotating wheel assemblies 26 slide on the rollers 34 in contact with the underlying planar surface "S". By balancing the drive of the wheel assemblies 26 of the three legs 20, 22, 24, the toy vehicle 10 can move in any direction with the forward end facing in one constant direction or as it is rotated in any direction. For example, when the wheel assembly 26*c* of the rear leg 24 rotates in the clockwise direction when viewed from the perspective of the chassis 12 looking out the leg 24, the toy vehicle moves generally towards the left lateral side 12*d*. The taper of the rollers 34 allows the wheel assemblies 26 to slide as necessary when the toy vehicle 10 is moving a direction that is not normal to the axis of the roller 34. The wheel assembly 26 may rotate slightly until the taper of the roller 34 matches the direction of the travel of the toy vehicle 10 so that that axis of rotation of the roller 34 is normal to the direction of travel. Alternatively, the wheel assembly 26 will rotate as necessary to achieve the programmed or imputed motion. This allows the toy vehicle 10 to translate when the toy vehicle 10 is in the non-orthogonal position. The toy vehicle 10 may also combine the rotating and translating movements described above so as to rotate the toy vehicle 10 while translating. This allows the toy vehicle 10 to move in any planar direction and gives the appearance that the toy vehicle 10 is gliding or hovering on the planar surface S.

Control circuitry 152 on the toy vehicle 10 preferably is configured to switch from holonomic motor control, in the Y-shape or "attack" mode, to straight independent motor control in the T-shaped or "interceptor" mode, driving the wheel assemblies 26*a* and 26*b* of just the left and right legs 20, 22. If desired, the control circuitry 152 can be configured to provide appropriate power to the motor driving the wheel 26*c* of the rear leg 24 as well if a turning command is received while in the orthogonal mode.

FIGS. 8-9 are schematics of presently preferred circuits of the handheld remote control 32 and vehicle 10. The remote control 32 (FIG. 7) is used to transmit operation signals from a control circuit 152 (FIG. 8) in the remote control 32 to a vehicle control circuit 150 located within the toy vehicle 10. The remote control 32 comprises a housing 80 that contains a power supply 114 such as one or more batteries. The remote control 32 includes a control knob 82 for controlling the movement of the toy vehicle 10. The control knob 82 is configured as a paddle-ball joystick and may be pushed in any lateral direction or twisted or both to command movement of the toy vehicle 10. The remote control 32 also preferably includes a plurality of special effect control buttons, e.g. 84, 86, 88, 90, 92, corresponding to first, second, third, fourth and fifth 85, 87, 89, 91, 93 switches in the control circuitry 94, respectively, to control a variety of functions and pre-programmed settings. For example, the first control button 84 and the first switch 85 may activate the central motor 42 in the first direction to toggle the toy vehicle between the T-shaped mode and the Y-shaped mode. The second control button 86 and the second switch 87 may activate the central motor 42 in the second direction to activate the disc launcher 58. The third control button 88 and the third switch 89 may perform the preprogrammed function of moving back and forth in the Y-shaped mode along an arcuate path and shooting discs 60 toward the general center of the arcuate path. The fourth control button 90 and the fourth switch 91 may perform the preprogrammed function of spinning about the center of the toy vehicle 10 and translating in a first direction. The fifth control button 92 and the fifth switch 93 may perform the preprogrammed function of spinning without translating. The buttons 84, 86, 88, 90, 92 may be any shape and may be positioned anywhere on the remote control 32. Additionally, though buttons 88, 90, 92 for performing the preprogrammed functions described above are preferred, it is within the spirit and scope of the present invention that any combination of movements or functions be included as a preprogrammed function and associated with any button.

Figure 8A:
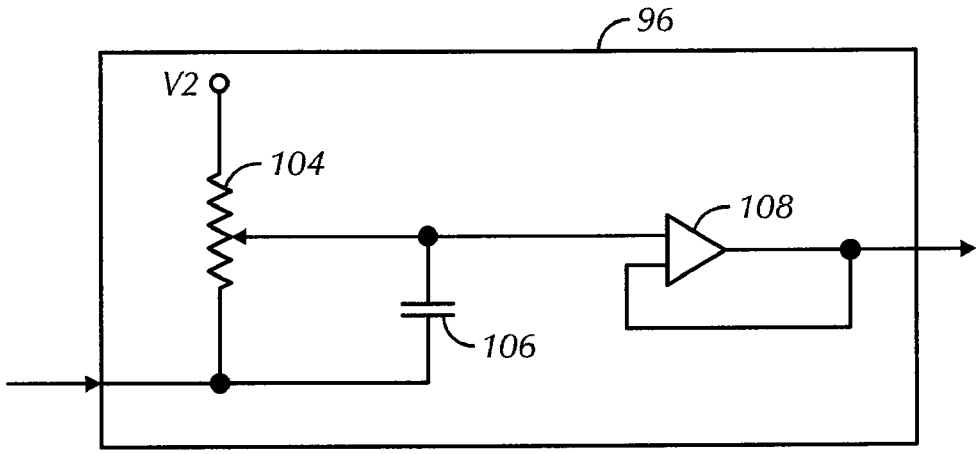

Referring to FIG. 8, the currently preferred but only exemplary control circuitry 152 includes a microprocessor 94 which receives signals from the first, second, third, fourth and fifth switches 85, 87, 89, 91, 93. A first position sensor 96 (corresponding to the x coordinate position), a second position sensor 98 (corresponding to the y coordinate position) and a third sensor 100 (corresponding to the direction or direction and degree of rotation) communicate with microprocessor 94 through a multiplexer 102. As shown in FIG. 8*a*, each position sensor 96, 98, 100 includes a potentiometer 104, capacitor 106 and amplifier 108. The microprocessor 94 then sends a signal to a transmitter circuit 110 for communicating the signal to the toy vehicle 10. The power supply 114, with corresponding supply lines V1, V2, power the transmitter 110 and the microprocessor 94. It provides power to the other sub-circuits including the position sensors 96, 98, 100 respectively. An ON/OFF switch 112 is provided to turn the remote control 32 ON or OFF.

Referring to FIG. 9, the currently preferred but only exemplary vehicle control circuit 150 receives the signal from the transmitter 110 in a receiver 116. The receiver 116 then sends the signal to a microprocessor 118. Limit switches 132, 134 terminate the circuit once the toy vehicle reaches the desired mode (Y or T shaped) as sensed by limit sensors (not shown). The microprocessor 118 is in communication with first, second, third and fourth motor control circuits 120, 122, 124, 126 to separately and independently reversibly control the corresponding drive motors M1, M2, M3 and the central motor 42. The power supply 128 and an ON/OFF switch 130 are used to provide to power the toy vehicle 10 and turn the remote toy vehicle 100N or OFF.

The microprocessor 118 preferably controls the various drive motors M1, M2, M3 with pulse width modulated signals and uses a table-lookup to determine the ratio of duty cycle that is applied to each drive motors M1, M2, M3 to get the desired vector of motion. These can be appropriately combined with other values to get the desired rotation with translation. The described system preferably employees proportional speed control. XXX refers to a 3 bit binary signal component or packet sent from the microprocessor 94 in the remote control 32, corresponding to a direction and degree of left or right motion of the control knob 82. YYY refers to a 3 bit binary component and packet signal similarly corresponding to forward or backward motion of the control knob 82. Another 3 bit binary signal ZZZ (not depicted) similarly corresponds to a direction and degree rotation or twist of the control knob 82. Each positional direction of the control knob 82 has a plurality of levels. For example, the control knob 82 can be urged to the right slightly for a first level, further to the right for a second level and completely to the right for a third level corresponding to a plurality of operating speeds, for example, a slow, e.g. maximum operation of 50% of the top speed, a medium, i.e. 70%, or a fast, i.e. 100% of the respective drive motor M1, M2, M3.

TABLE 1

| | yyy | | | | | | |
|---|---|---|---|---|---|---|---|
| xxx | 110<br>M1, M2 | 101<br>M1, M2 | 100<br>M1, M2 | 011<br>M1, M2 | 010<br>M1, M2 | 001<br>M1, M2 | 000<br>M1, M2 |
| 110 | 75% FW,<br>100% BW | 83% FW,<br>100% BW | 88% FW,<br>100% BW | 100% FW,<br>100% BW | 100% FW,<br>88% BW | 100% FW,<br>83% BW | 100% FW,<br>75% BW |
| 101 | 53% FW,<br>100% BW | 58% FW,<br>91% BW | 62% FW,<br>85% BW | 70% FW,<br>70% BW | 85% FW,<br>62% BW | 91% FW,<br>58% BW | 100% FW,<br>53% BW |
| 100 | 38% FW,<br>100% BW | 42% FW,<br>85% BW | 44% FW,<br>75% BW | 50% FW,<br>50% BW | 75% FW,<br>44% BW | 85% FW,<br>42% BW | 100% FW,<br>38% BW |
| 011 | 0%,<br>100% BW | 0%,,<br>70% BW | 0%,,<br>100% BW | 0%,<br>0% | 50% FW,<br>0% | 70% FW,<br>0% | 100% FW,<br>0% |
| 010 | 38% BW,<br>100% FW | 42% BW,<br>85% FW | 44% BW,<br>75% FW | 50% BW,<br>50% FW | 75% BW,<br>44% FW | 85% BW,<br>42% FW | 100% BW,<br>38% FW |
| 001 | 53% FW,<br>100% FW | 58% BW,<br>91% FW | 62% BW,<br>85% FW | 70% BW,<br>70% FW | 85% BW,<br>62% FW | 91% BW,<br>58% FW | 100% BW,<br>53% BW |
| 000 | 75% BW,<br>100% FW | 83% BW,<br>100% FW | 88% BW,<br>100% BW | 100% BW,<br>100% FW | 100% BW,<br>88% FW | 100% BW,<br>83% FW | 100% BW,<br>75% FW |

TABLE 2

| | yyy | | | | | | |
|---|---|---|---|---|---|---|---|
| xxx | 110<br>M1, M2, M3 | 101<br>M1, M2, M3 | 100<br>M1, M2, M3 | 011<br>M1, M2, M3 | 010<br>M1, M2, M3 | 001<br>M1, M2, M3 | 000<br>M1, M2, M3 |
| 110 | 0%,<br>100% BW,<br>100% FW | 30% FW,<br>100% BW,<br>70% FW | 50% FW,<br>100% BW,<br>50% FW | 100% FW,<br>100% BW,<br>0% | 100% FW,<br>50% BW,<br>50% BW | 100% FW,<br>30% BW,<br>70% BW | 100% FW,<br>0%,<br>100% BW |
| 101 | 10.5% BW,<br>80.5% BW,<br>100% FW | 0%,<br>70% BW,<br>70% FW | 25% FW,<br>75% BW,<br>50% FW | 70% FW,<br>70% BW,<br>0% | 75% FW,<br>50% BW,<br>25% BW | 70% FW,<br>0%,<br>70% BW | 80.5% FW,<br>10.5% BW,<br>100% BW |
| 100 | 17.5% FW,<br>67.5% BW,<br>100% FW | 12.25% BW,<br>47.25% BW,<br>70% FW | 0%,<br>50% BW,<br>50% FW | 50% FW,<br>50% BW,<br>0% | 50% FW,<br>0% BW,<br>50% BW | 47.25% FW,<br>12.25% FW,<br>70% BW | 67.5% FW,<br>17.5% BW,<br>100% BW |
| 011 | 26% BW,<br>26% BW,<br>100% FW | 21% BW,<br>21% BW,<br>70% FW | 19% BW,<br>19% BW,<br>50% FW | 0%,<br>0%,<br>0% | 19% FW,<br>19% FW,<br>50% BW | 21% FW,<br>21% FW,<br>70% BW | 26% FW,<br>26% FW,<br>100% BW |
| 010 | 67.5% BW,<br>17.5% BW,<br>100% FW | 47.25% BW,<br>12.25% BW,<br>70% FW | 50% BW,<br>0%,<br>50% FW | 50% BW,<br>50% BW,<br>0% | 0%,<br>50% FW,<br>50% BW | 12.25% FW,<br>47.25% FW,<br>70% BW | 17.5% FW,<br>67.5% FW,<br>100% BW |
| 001 | 80.5% BW,<br>10.5% BW,<br>100% FW | 70% BW,<br>0%,<br>70% FW | 75% BW,<br>50% FW,<br>25% FW | 70% BW,<br>70% FW,<br>0% | 25% BW,<br>75% FW,<br>50% BW | 0%,<br>70% FW,<br>70% BW | 17.5% FW,<br>67.5% FW,<br>100% BW |
| 000 | 100% BW,<br>0%,<br>100% FW | 100% BW,<br>30% FW,<br>70% FW | 100% BW,<br>50% FW,<br>50% FW | 100% BW,<br>100% FW,<br>0% | 50% BW,<br>100% FW,<br>50% BW | 30% BW,<br>100% FW,<br>70% BW | 10.5% FW,<br>80.5% FW,<br>100% BW |

Tables 1 and 2 show exemplary PWM ratios that may be used to control power supplied by the vehicle microprocessor 118 to the various drive motors M1, M2, M3 and drive the toy vehicle 10 in the direction and at the speed identified by the XXX/YYY binary codes generated and transmitted by the remote control 32. In the T-shaped mode (FIG. 10A) as shown in Table 1, only M1 and M2 PWM ratios, corresponding to the drive motors M1, M2 in the left and right legs 20, 22, respectively, are generated, though, as mentioned above, it is within the spirit and scope of the present invention that the motor (M3) of the wheel assembly 26 on the rear leg 24 be activated as well. Preferably, the remote control 32 generates and the toy vehicle 10 uses seven XXX outputs (corresponding to three left, a central and three right positions of the control knob 82). They also generate or use, respectively, seven YYY outputs (corresponding to three up/forward, a central and three down/rearward positions of the control knob 82). Collectively these provide one stationary command and forty-eight commanded translational movements and position of the toy vehicle 10 based only on planar (X/Y) movement of the control knob 82. For example, when the control knob 82 is untouched, the XXX output is 011 and the YYY output is 011. The drive motors M1 and M2 are provided 0% power such that the toy vehicle 10 remains stationary. When the control knob 82 is urged to the maximum position forward, the XXX output is 110 (top row) and the YYY output is 011 (center column) The drive motor M1 of the left leg 20 is provided with 100% "forward" ("FW" or "CW") power and the drive motor M2 of the right leg 22 is provided with 100%

"backward" ("BW" or "CCW") power (see FIG. 10*a* for drive motor M1, M2, M3 directions) such that the toy vehicle 10 moves at its maximum speed forward. When the control knob 82 is urged completely to the maximum right and upward (northeast) position, the XXX output is 000 (rightmost column) and the YYY output is 110 (topmost row). The drive motor M1 of the left leg 20 is provided with 100% "forward" power but the drive motor M2 of the right leg 22 is provided with only 75% "backward" power such that the toy vehicle 10 moves forward while turning in a clockwise, viewing the toy vehicle 10 from above, direction. As the control knob 82 is moved downward along the right side of the remote control 32, less power is supplied to the right leg drive motor M2 resulting in a tighter right forward turn of the vehicle 10 until an only right turn movement at the right center position of the control knob (000/011).

In the Y-shaped mode, a similar method is used except the drive motor M3 of the rear side leg 24 is also activated to achieve holonomic movement. Table 2 is read in the same way as that of Table 1 except that the movement of the toy vehicle is with respect to the then forward facing position of the toy vehicle. For example, a left-most horizontal movement of the control knob would generate a 110/011 XXX/YYY output from the remote control 32 and a leftward sliding movement of the toy vehicle 10 from its then current position without rotation. No linear (X-Y) movement of the control knob in this holonomic configuration of the vehicle 10 and vehicle microprocessor mode of operation will cause the toy vehicle to rotate. Twist (ZZZ) control must be added.

The ZZZ output, or twist of the control knob 82, is not included either the T-shaped mode or the Y-shaped mode data of Tables 1 and 2. There should be at least three twist control values (ZZZ) for clockwise, counterclockwise and neutral/no twist control. Preferably multiple values of level or degree of twist can be implemented. For example, seven ZZZ values would provide three levels of twist (slight twist, moderate twist and full twist) in either direction.

Twist can be combined with the planar (XXX/YYY) PWM ratios in either Tables 1 or 2 in various ways. For example, a separate table of ZZZ PWM values for can be created for each motor and combined with the values for the same motors for the commanded planar movement from Tables 1 and 2. Alternatively, an algorithm can be created to apply to the ratio values of the Tables 1 and 2 to alter those values for use. The algorithm might consist of three different equations or scale factors, one for each different degree of twist. Where new PWM values would exceed 100%, those that would have exceeded 100% would be limited to 100%. Alternatively, the motor ratios exceeding 100% can be scaled down to 100% and the other motor ratios scaled down appropriately. That might be exactly equal downscaling or a proportional downscaling. No motor PWM ratio would be more than 100%. Alternatively, motor PWM values may be determined empirically and loaded into a plurality of different tables so that the ZZZ value would be used to identify one of the tables to be used and the XXX/YYY values used to identify a particular sets of motor PWM ratios to use with the commanded degree and direction twist.

It will be appreciated by those skilled in the art that changes could be made to the embodiment described above without departing from the broad inventive concept thereof. For example, although the invention is described herein in terms of the preferred, three-legged embodiment with six rollers on each leg, the present invention could also comprise a vehicle having additional legs and more or less rollers. The toy vehicle 10 is preferably controlled via radio (wireless) signals from the remote control 32. However, other types of controllers may be used including other types of wireless controllers (e.g. infrared, ultrasonic and/or voice-activated controllers) and even wired controllers and the like. Alternatively, the toy vehicle 10 may be self-controlled with or without preprogrammed movement. Sensors may be provided responsive to movement of the legs 20, 22, 24 and the surrounding environment for example, contact/pressure switches or proximity detector spaced around the outer periphery of the toy vehicle 10, to automatically adjust the movement of the toy vehicle 10 with respect to obstacles. The toy vehicle 10 can be constructed of, for example, plastic or any other suitable material such as metal or composite materials. Also, the dimensions of the toy vehicle 10 shown can be varied, for example making components of the toy vehicle smaller or larger relative to the other components. It is understood, therefore, that changes could be made to the preferred embodiment 10 of the toy vehicle described above without departing from the broad inventive concept thereof. It is understood, therefore, that this invention is not limited to the particular embodiment disclosed, but is intended to cover modifications within the spirit and scope of the present application.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A three wheeled toy vehicle comprising:

a chassis;

first, second and third wheels supported for rotation from the chassis and supporting the chassis for movement on a surface, the first wheel being operably and pivotably connected to the chassis by a first leg, the first leg being pivotable toward and away from the second and third wheels, each of the first, second and third wheels having a respective first, second and third axis of rotation, each of the first, second and third axes of rotation lying between the remaining two other axes of rotation such that the three axes of rotation are mutually adjoining and each of the three axes of rotation crosses over the other two axes of rotation such that an angle is formed between each adjoining crossing pair of the axes of rotation and each adjoining pair of the first, second and third wheels, and the angle formed between each adjoining pair of axes of rotation is other than multiples of about 90 degrees;

at least a separate motor operably connected with each separate one of the first, second and third wheels to drive each separate wheel independently about its axis of rotation; and a microprocessor operably connected with at least all three of the separate motors to control power supplied to each of the three separate motors, and at least two different sets of duty cycle ratios used by the microprocessor to control power supplied to the three separate motors, at least one set including non-zero, duty cycle ratios for only the two separate motors operably connected with the first and second wheels, and at least another set including non-zero duty cycle ratios for all three of the separate motors to propel the toy vehicle holonomically in any translational direction across a support surface.

2. The toy vehicle of claim 1, wherein each of the angles is greater than 90 degrees and less than 180 degrees.

3. The toy vehicle of claim 2, wherein each of the angles is approximately 120 degrees.

4. The toy vehicle of claim 1, wherein the second wheel is operably and pivotably connected to the chassis by a second leg, the second leg being pivotable toward and away from the first and third wheels.

5. The toy vehicle of claim 4, wherein at least each of the first and second legs are positionable in at least two different orientations with respect to the chassis and the third wheel so as to change the angle between each adjoining pair of wheels.

6. The toy vehicle of claim 5 wherein the at least one motor operably connected with at least one of the first and second wheels is reversible so as to rotate the at least one wheel about its axis of rotation.

7. The toy vehicle of claim 5 further comprising at least one motor operably connected with the first and second wheels so as to reorient the first and second wheels with respect to the chassis and the third wheel and change the angle between each adjoining pair of wheels.

8. The toy vehicle of claim 5 wherein the at least one motor operably connected with the third wheel is reversible so as to rotate the third wheel about its axis of rotation.

9. The toy vehicle of claim 1 wherein a first one of the separate motors is supported on the first leg drivingly connected with the first wheel to rotate the first wheel around the first axis.

10. The toy vehicle of claim 1 further comprising a transformation motor drivingly connected to at least the first leg so as to reorient the first leg and the first wheel with respect to the chassis and the second and third wheels.

11. The toy vehicle of claim 1, wherein each of the first and second legs is repositionable so as to extend away from one another and form an angle of about 180 degrees with each other.

12. The toy vehicle of claim 1 wherein each of the two sets includes duty cycle ratios that provide proportional speed control of the vehicle.

13. The toy vehicle of claim 1 wherein at least one of the at least two sets includes duty cycle ratios as set forth in one of the Tables 1 and 2.

14. A three wheeled toy vehicle comprising:

a chassis having a front end and an opposing rear end;

three independently operated drive motors, and a rear leg and two front legs each extending from the chassis, the two front legs being pivotably attached to the chassis such that the angle between the two front legs is variable, each leg including a wheel with a central axis of rotation generally parallel in plan view to the leg from which the wheel assembly is attached, each wheel being driven by a separate one of the drive motors, the toy vehicle having only three of the wheels, each wheel being supported by a different one of the two front legs and the rear leg, wherein the central axis of rotation of each wheel is non-adjustably fixed with respect to the leg supporting the wheel and wherein each of the two front legs is pivotably attached to the chassis so as to pivot about a separate axis generally perpendicular to a plane supporting the toy vehicle on the three wheels.

15. The toy vehicle of claim 14, wherein each wheel comprises an assembly including a plurality of rollers that collectively define an outer diameter of the assembly and the wheel and that are each freely rotatable about an axis that is generally perpendicular to a central axis of rotation of the wheel and the assembly.

16. The toy vehicle of claim 14, wherein the motors are controlled by a remote control, the remote control having a control knob, the control knob having a central axis and being twistable about the central axis and translatable for respectively turning and translating the toy vehicle separately and in combination.

17. The toy vehicle of claim 16, wherein the remote control has at least one button for activating a preset motion of the toy vehicle.

18. The toy vehicle of claim 14, wherein the chassis includes a mode motor operably connected with the two front legs so as to pivot the two front legs between an inline position and an alternate position, the two front legs being generally parallel in the inline position and the two front legs spaced generally 120 degrees apart in the alternate position.

19. The toy vehicle of claim 18, wherein only the wheels of the two front legs are operated by their respective motor in the inline position.

20. The toy vehicle of claim 19, wherein the chassis includes a face plate pivotably attached to the chassis, the face plate pivoting from a closed position when the two front legs are in the inline position to an open position when the two front legs are in the alternate position.

21. The toy vehicle of claim 20 further comprising a disc tosser, the disc tosser being exposed when the face plate is in the open position, the disc tosser being capable of firing discs from the chassis.

22. The toy vehicle of claim 20, wherein the chassis includes at least one light, the at least one light is exposed when the face plate is in the open position.

23. A three wheeled toy vehicle comprising:

a chassis having a front end and an opposing rear end;

three independently operated drive motors, and a rear leg and two front legs each extending from the chassis, the two front legs being pivotably attached to the chassis such that the angle between the two front legs is variable, each leg including a wheel with an axis of rotation generally parallel in plan view to the leg from which the wheel assembly is attached, each wheel being driven by a separate one of the drive motors, wherein the two front legs are left and right front legs; and a microprocessor operably connected with at least the three drive motors, and at least two different sets of duty cycle ratios used by the microprocessor to control power supplied to the three drive motors, at least one set including duty cycle ratios for only two of the three drive motors operably connected with each separate one of the wheel assemblies of the left and right front legs, and at least another set including duty cycle ratios for all three of the separate drive motors to propel the vehicle holonomically in any translational direction across a support surface.

24. The toy vehicle of claim 23 wherein each of the two sets includes duty cycle ratios that provide proportional speed control of the vehicle.

25. The toy vehicle of claim 23 wherein at least one of the at least two sets includes duty cycle ratios as set forth in one of the Tables 1 and 2.

* * * * *